US005251391A

United States Patent [19]

Lan

[11] Patent Number: 5,251,391

[45] Date of Patent: Oct. 12, 1993

[54] ILLUMINANT PHOTO FRAME

[76] Inventor: Ching-Hwei Lan, No. 9, Alley 1, Lane 458, Yuang Ho Rd., Chung Ho City, Taiwan

[21] Appl. No.: 828,042

[22] Filed: Jan. 30, 1992

[51] Int. Cl.[5] ..... G09F 13/00

[52] U.S. Cl. ..... 40/152.2; 40/546; 362/31

[58] Field of Search ..... 40/152.2, 152, 154, 40/442, 427, 463, 902, 546; 362/83.3, 27, 31, 61

[56] References Cited

U.S. PATENT DOCUMENTS

| | | | |
|---|---|---|---|
| 4,934,079 | 6/1990 | Hoshi | 40/463 |
| 5,075,826 | 12/1991 | Lan | 40/546 |
| 5,147,129 | 9/1992 | Ku | 362/31 |

FOREIGN PATENT DOCUMENTS

| | | | |
|---|---|---|---|
| 465376 | 12/1951 | Italy | 362/31 |

*Primary Examiner*—Kenneth J. Dorner
*Assistant Examiner*—Cassandra Hope Davis
*Attorney, Agent, or Firm*—Browdy and Neimark

[57] ABSTRACT

An illuminant photo frame, comprising: a transparent frame body constituted by elongated lines and cross lines respectively having a back side created with a plurality of integrant 45° prisms in more than one flight of stages to collectively form a certain pattern, a recess arranged at the back side of the naturally met elongated and cross lines in cross opposition to the other for installing a small bulb each thereat, and a photoresistance in control of electricity supply to small bulbs to have them transmit lights automatically at night, which sent from two sides of each recess to travel forward alongside elongated and cross lines will make an internal total reflection at each 45° slant of the prism to project out of the front side, thereby, with a crystal illumination given to the pattern. And the electricity supply will automatically cease at daytime.

4 Claims, 2 Drawing Sheets 22-22 SECTION

ILLUMINANT PHOTO FRAME

FIELD OF THE INVENTION

The present invention relates to photo frame, and particularly to an illuminant one that at night automatically provides photo an illumination for convenience of people's appreciation and if preferred may be also used as a night light.

BACKGROUND OF THE INVENTION

Conventionally used photo or picture frame, whether elegant or general, is totally unable to give photo or picture viewers any benefit of illumination to help them see it clearly at night. Such inconvenience exists particularly when a photo or picture is decoratively mounted high in the dimness of lights. To solve the problem, an illuminant photo frame is greatly needed.

OBJECTS OF THE INVENTION

In order for a photo frame's illumination, the present invention provides a structurally new kind of photo frame which has the following features:

1. It can sense extent of the outside lights' darkness or brightness to start and cease the electricity supply.
2. All light bulbs are hidden in the cross-section area without affecting any of its exterior beauty.
3. The back side of the transparent frame, where a plurality of integrantly created 45° prisms collectively form a certain pattern, will reflect light emitted from the small light bulbs in the cross section of the frame to project out of the front side of the frame, and thereby, provide a crystal illumination of the pattern presentation.
4. It may also serve as a small light bulb at night in the living room or bedroom.

SUMMARY OF THE INVENTION

An illuminant photo frame comprises a transparent frame body formed by upper and lower frame staves and side stays. The back sides of both the frame staves and side stays include a plurality of integrantly created 45° prisms in more than one flight of stages to collectively form a certain pattern. A recess is formed at the back side of joints formed at the connection of the frame staves to the side stays; in which is installed a small light bulb respectively, and a PC board connected to the back side of the frame body is photoresistance on the PC board which installed has connection with the small light bulbs via a power lead. At night, the pattern of the frame will be crystally presented from reflected light emitted automatically at night when the small light bulbs are energized. The electricity supply will automatically cease when daytime comes when interrupted by the photoresistance device on the PC board.

SPECIFIC DESCRIPTION OF THE INVENTION

Figure 1:
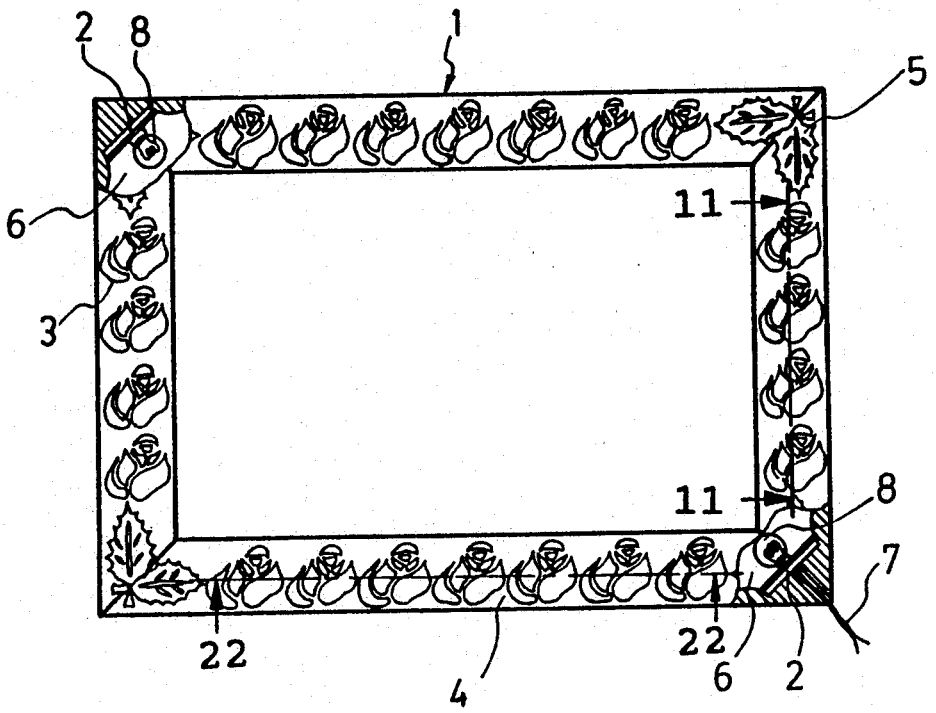
FIG. 1 a front perspective view of the inventive photo frame but with local cutaway view.
Figure 2:
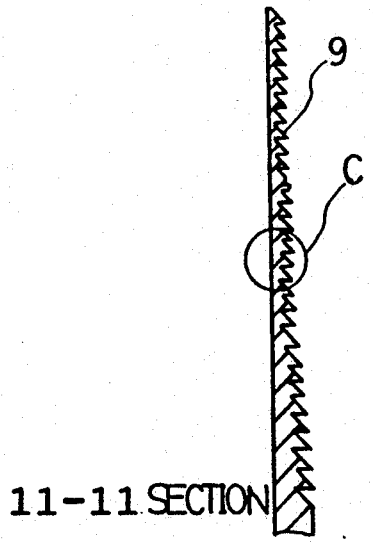
FIG. 2 is a sectional view taken along the A—A line in FIG. 1.
Figure 4:
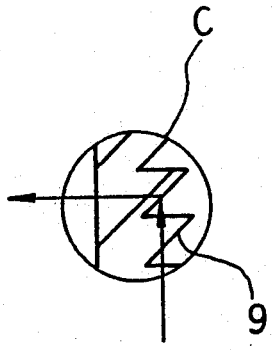
FIG. 4 is an enlarged action view of the C part in FIG. 2.
Figure 3:
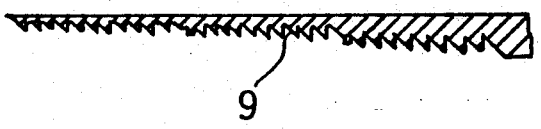
FIG. 3 is a sectional view taken along the B—B line in FIG. 1.

FIGS. 1, 2 and 3 show, the inventive photo frame is combined by a frame body 1 and a PC board 2. The frame body 1 which is made from a transparent material is constituted by elongated frame staves 3 and side stays 4, and the back sides of which respectively include a plurality of integrantly created 45° prisms in more than one flight of stages to collectively form a decorative pattern 5. At the back side of the joint between elongated frame staves 3 and side stays 4, a recess 6 with two sides opposite each other between which is respectively installed a small bulb 8. Small bulbs 8 are connected with the circuit of PC board 2 through a power lead 7. In this way, upon energizing small bulbs 8, the light emitted travels through the two sides of each recess 6 forward alongside elongated frame staves 3 and side stays 4. At each 45° slant 9 of the 45° prism the emitted light is reflected so as to project out of the front side of frame body 1 (as FIG. 4 shows), thereby providing a crystal illumination of decorative pattern 5. On PC board 2 there is installed a photoresistance circuit (CDS) which turns the power source on at night and off at daytime automatically.

Figure 5:
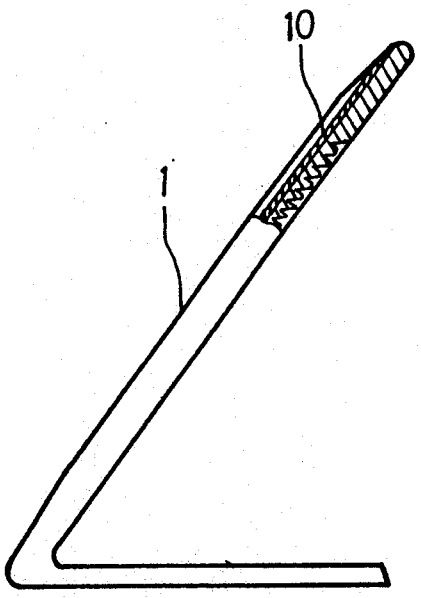
FIG. 5 is a perspective view of an examplery photo clamper of the invention but includes a local cutaway view thereof.

As FIG. 5 shows, the invention's application can also go to a photo clamper 10 which is transparent and put on desk for end of decoration use. In it, a plurality of integrant 45° prisms collectively forming a certain pattern 5 are created on the back side of it except for the area of photo mounting. Small bulbs 8 of PC board 2 may be installed at any suitable position inside the cross section thereof. In this way the same illumination effects are achieved.

The power source PC board 2 uses may come from a battery or by use of an assembly converting alternating-current power supply into direct-current source.

It is understandably noted that frame body 1 is not limited to any specific square, circular or other shape.

I claim:

1. An illuminant photo frame and night lamp, comprising;
   - a transparent photo support means for supporting and displaying a photo,
   - said transparent photo support means having a front side and back side,
   - at least one recess formed on said back side,
   - a plurality of integrant 45° prisms adjacent to said at least one recess forming selected patterns on said back side,
   - a small light bulb engaged to a PC board installed in said at least one recess,
   - said PC board having a photoresistance (CDS) circuit for sensing light and actuating an electricity supply for said small light bulb,
   - wherein when said photoresistance (CDS) circuit actuates said light bulb, light emitted therefrom travels in said transparent photo support means until reflected out said front side by said 45° prisms to brightly illuminate said selected patterns, display a photo and function as a night lamp.

2. The illuminant photo frame and night lamp according to claim 1,
   - wherein said transparent photo support means comprises,
   - an upper frame stave, a lower frame stave, and two side stays each having ends respectively engaged to an end of said upper frame stave and an end of said lower frame stave, wherein, said at least one recess is located at a first joint between said lower frame stave and one of said two side stays.

3. The illuminant photo frame and night lamp according to claim 2, wherein a second said recess is located at a second joint between said upper frame stave and another of said two side stays diagonally opposite said first joint.

4. The illuminant photo frame and night lamp according to claim 1, wherein, groups of said 45° prisms are respectively arranged in a plurality of planes parallel to said front side of said transparent photo support means.

* * * * *